US006481255B2

(12) United States Patent
Theriault et al.

(10) Patent No.: US 6,481,255 B2
(45) Date of Patent: Nov. 19, 2002

(54) HIGH SECURITY SIDE BAR LOCK

(75) Inventors: Kenneth T. Theriault, Meriden, CT (US); Charles W. Eden, Jr., Plantsville, CT (US)

(73) Assignee: International Security Products, Inc., Southington, CT (US)

( * ) Notice: Subject to any disclaimer, the term of this patent is extended or adjusted under 35 U.S.C. 154(b) by 0 days.

(21) Appl. No.: 10/041,143

(22) Filed: Jan. 4, 2002

(65) Prior Publication Data

US 2002/0056301 A1 May 16, 2002

Related U.S. Application Data

(63) Continuation of application No. 09/388,574, filed on Sep. 1, 1999.

(51) Int. Cl.[7] ..... E05B 27/00
(52) U.S. Cl. ..... 70/495; 70/409
(58) Field of Search ..... 70/495, 496, 406, 70/409, 411, 419, 389, 390, 358

(56) References Cited

U.S. PATENT DOCUMENTS

| | | | | | |
|---|---|---|---|---|---|
| 3,035,433 | A | * | 5/1962 | Testa | 70/495 |
| 4,404,824 | A | * | 9/1983 | Hennessy | 70/495 |
| 4,434,636 | A | * | 3/1984 | Prunbauer | 70/495 |
| 4,638,651 | A | * | 1/1987 | Surko, Jr. | 70/495 |
| 5,819,566 | A | * | 10/1998 | Eden, Jr. | 70/409 X |
| 5,819,567 | A | * | 10/1998 | Eden, Jr. | 70/389 X |
| 5,823,030 | A | * | 10/1998 | Theriault et al. | 70/389 X |
| 5,956,986 | A | * | 9/1999 | Vonlanthen | 70/495 X |
| 5,970,761 | A | * | 10/1999 | Eden, Jr. | 70/389 X |
| 6,105,404 | A | * | 8/2000 | Field et al. | 70/409 X |
| 6,134,929 | A | * | 10/2000 | Widen | 70/409 X |
| 6,308,543 | B1 | * | 10/2001 | Yoshizawa | 70/409 X |

FOREIGN PATENT DOCUMENTS

| | | | | |
|---|---|---|---|---|
| EP | 237799 | * | 9/1987 | 70/495 |
| WO | 8704749 | * | 8/1987 | 70/495 |
| WO | 93/12313 | * | 6/1993 | 70/495 |

* cited by examiner

*Primary Examiner*—Suzanne Dino Barrett
(74) *Attorney, Agent, or Firm*—Alix, Yale & Ristas, LLP

(57) ABSTRACT

A side bar type cylinder lock includes a locking segment which is movable relative to the side bar and lock shell only in response to insertion of a key blade having a uniquely configured and located camming projection into the keyway. The locking segment movement is independent of lock tumbler movement and is required to permit side bar disengagement from the lock shell.

22 Claims, 5 Drawing Sheets

HIGH SECURITY SIDE BAR LOCK

RELATED APPLICATION

This application is a Continuation of U.S. application Ser. No. 09/388,574, filed Sep. 1, 1999, and claims the benefit thereof under 35 USC §120.

BACKGROUND OF THE INVENTION

1. Field of the Invention

The present invention relates to cylinder locks and, particularly, to cylinder locks which incorporate side bars to enhance mechanical strength and thereby improve the ability to resist defeat through the application of torque to the cylinder. Specifically, this invention relates to enhancing the security afforded by side bar type cylinder locks by increasing the number of possible key combinations of such locks while simultaneously reducing the possibility of manufacture of key blanks which may be cut to form unauthorized keys for such locks. Accordingly, the general objects of the present invention are to provide novel and improved articles and methods of such character.

2. Description of the Prior Art

Cylinder locks which employ side bars are well-known in the art. Early examples of such locks may be seen from U.S. Pat. Nos. 2,003,086 and 2,426,104. A more recent example of a side bar lock, wherein generally L-shaped tumblers which cooperate with the side bar are reciprocated through coaction thereof with a slot in the side of the blade of a cooperating key, may be seen from U.S. Pat. No. 4,756,177. While side bar locks have many applications, a typical use environment is to control access to a cache of coins such as, for example, in a parking meter. The use of a side bar lock in such an application is dictated by the enhanced ability of these locks to resist defeat by the application of torque to the lock cylinder.

A consistency in the field of security devices is the desire, both by lock manufacturers and users, for improvements which will reduce the possibility of unauthorized access through defeat of a lock. Such improvements may take the form of increased mechanical strength and/or increased "pick resistance". The latter type of improvement may, for example, be accomplished by increasing the number of possible combinations.

The selection of a complex keyway profile and/or variation of the number and orientation of the pin tumbler arrays will not eliminate the possibility of defeat of a cylinder lock. This fact, in part, results from the ready availability of key blanks having blades which, either as manufactured or as shaped using conventional key-cutting machines, can be "cut" to produce an unauthorized key which will operate a lock. Thus, the most common manner of defeating a cylinder lock consists of the formation of an unauthorized key from a commercially obtained key blank having a blade profile which matches the lock keyway cross-section. While security against defeat by unsophisticated villains may be achieved by incorporating sufficient mechanical strength in a lock, the ultimate degree of security can be accomplished only through the exercise of key control.

Cylinder locks which generally satisfy the above-discussed key control criteria, and particularly cylinder locks systems which include a unique key as a component thereof, are disclosed in U.S. Pat. Nos. 5,819,567 and 5,823,030.

SUMMARY OF THE INVENTION

The present invention provides a novel and improved cylinder lock and lock system and, in so doing, adapts the operational concept of above-referenced U.S. Pat. Nos. 5,819,567 and 5,823,030 to a side bar lock. A side bar lock in accordance with the present invention is characterized by enhanced resistance to defeat by both "picking" and overpowering.

A lock in accordance with the invention, for each side bar, is provided with at least a first locking segment which is carried by, and movable relative to, the core. Each such locking segment includes a projection, which normally extends into the keyway, and a portion which cooperates with the associated side bar. In the absence of a proper key in the keyway, the side bar is prevented from moving out of engagement with an elongated receiver, i.e., a cam groove, in the lock shell by interference between the side bar and a surface on the locking segment. An authorized, i.e., proper, key will include a camming projection which, through cooperation with the projection on the locking segment, causes the locking segment to move relative to the core and side bar. In a preferred embodiment, proper amount and direction of such movement will place the side bar in registration with the deeper portion of a stepped notch in the locking segment whereby, if all other code parts of the lock combination are satisfied by the "bitting" on the key, the application of torque to the key will result in the side bar being cammed out of the cooperating receiver in the shell.

The above-mentioned other code parts of the lock combination are defined by an array of reciprocal tumblers. These tumblers, in a preferred embodiment, include extensions which project into the keyway for engagement by longitudinal groove(s) in the side(s) of the key blade, the groove(s) typically having straight code parts and angled transition parts. In a preferred embodiment the tumblers, on the sides opposite to the extensions, are provided with slots. These tumbler slots define part of the lock code and cooperate with fingers extending from the side bar. The tumblers may, in the interest of enhancing pick resistance, be provided with multiple slots of different depth, only one of which is sufficiently deep to satisfy the code.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENT

Figure 1:
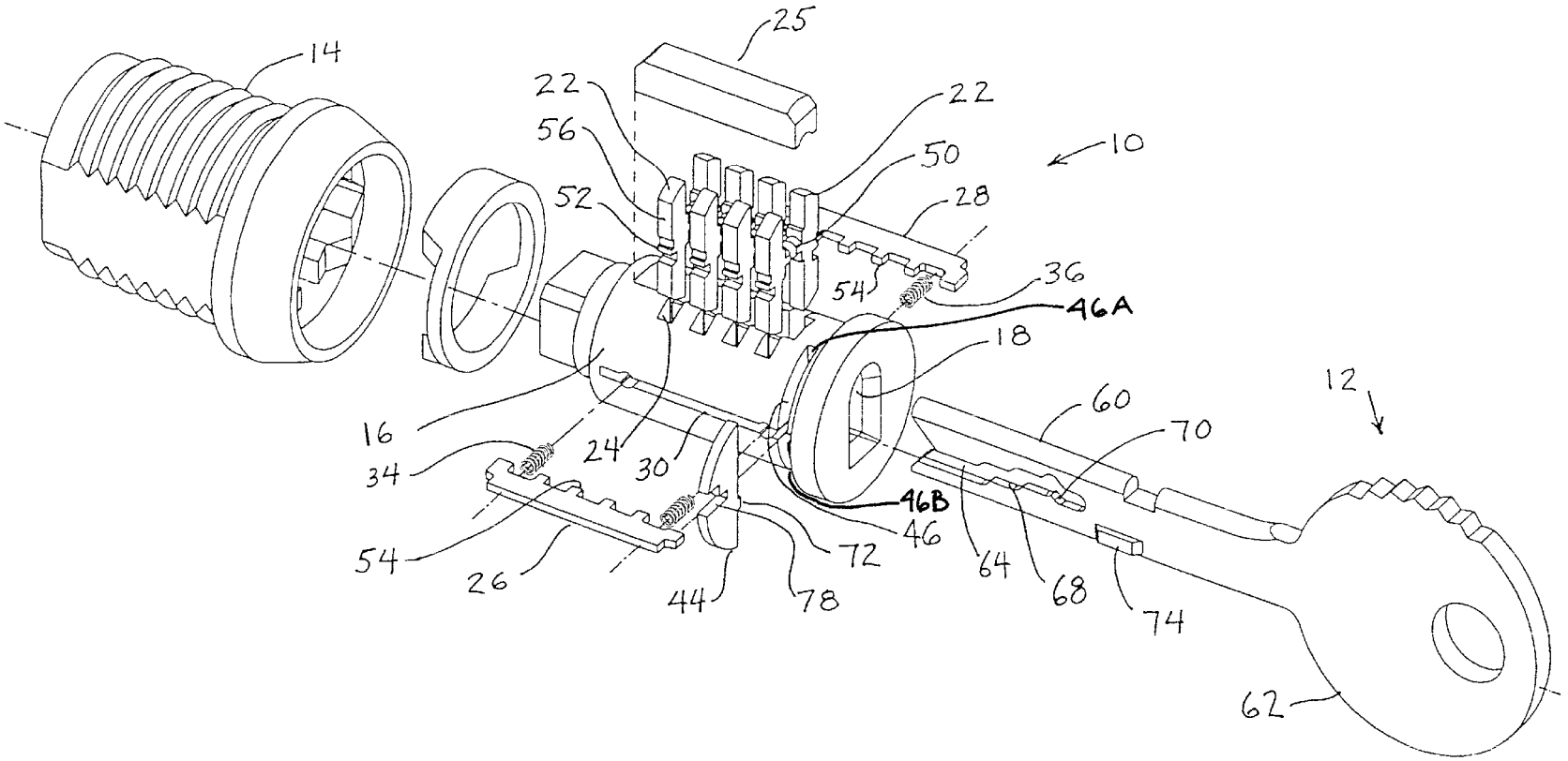
FIG. 1 is an exploded, perspective view of a first embodiment of a lock system in accordance with the invention.

As noted above, cylinder locks which incorporate side bars are well-known in the art and the operation thereof will, accordingly, not be discussed in detail herein. Referring to the drawings, a lock which includes a pair of side bars is indicated generally at 10 in FIG. 1. The lock 10 and a properly coded key therefor, as indicated generally at 12, define a lock system. Lock 10 includes a shell 14. Shell 14 defines a cylindrical chamber which receives a rotatable plug or core 16. The keyway 18 of lock 10 is formed in core 16. Keyway 18 has a pair of opposite sides which define, therebetween, a central plane 20 (see, for example, FIG. 3). A plurality of tumblers 22 are located, for reciprocal movement in planes oriented generally parallel to the center plane 20 of the keyway, in slots 24 provided in core 16. Slots 24, in the FIG. 1 embodiment, communicate with the opposite sides of keyway 18. The tumblers 22 are captured in the slots 24, such that reciprocal motion can be imparted thereto in the manner to be described below, by means of a retainer 25 which is press fit into a slot in core 16. In the FIG. 1 embodiment, tumblers 22 are urged in the downward direction, as the lock is shown, by gravity.

Lock 10 may include a pair of side bars 26 and 28, as shown in FIG. 1, or a single side bar 26, as shown in FIGS. 3–8. In the FIG. 1 embodiment the side bars are located in respective longitudinal slot, only one of which is shown at 30, in the exterior surface of core 16. The slots which receive the side bars communicate with the slots 24 which receive the tumblers 22 via chambers which extend from the bases of slots 30 toward the keyway. The side bar(s) are movable in plane(s) 42 oriented generally transverse to both the keyway defined plane 20 and the planes in which tumblers 22 move. The side bar(s) are biased outwardly, i.e., away from the keyway, by respective pairs of biasing springs as indicated 34 and 36 in FIG. 1.

Figure 3:
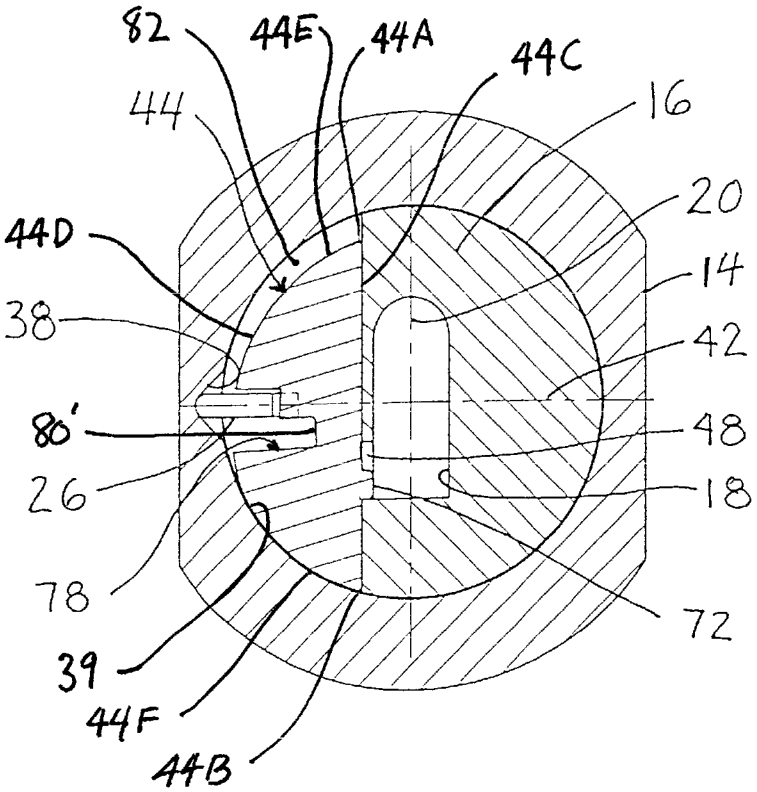
FIG. 3 is a cross-sectional, schematic front plan view of a second embodiment of a lock in accordance with the invention without a key in the keyway.
Figure 6:
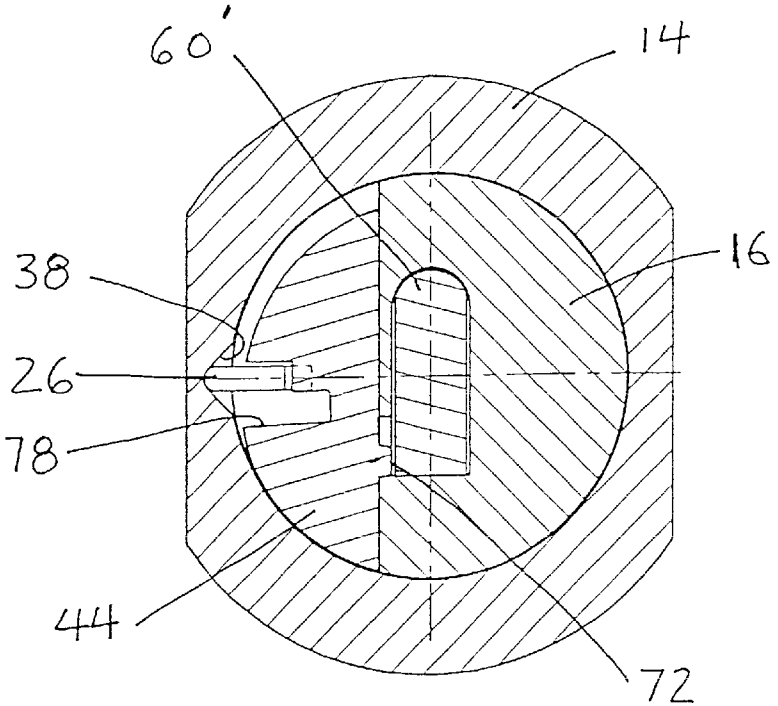
FIG. 6 is a view similar to FIG. 4 with an improper key inserted in the keyway.

As may be seen from FIGS. 3 and 6, in the absence of a properly coded key in keyway 18, the side bar 26 (or both side bars in the FIG. 1 embodiment) is biased resiliently into a longitudinal cam groove 38 provided in the inner wall of shell 14. The cam groove 38 is shaped such that, when a properly coded key is fully inserted in keyway 18 and torque applied thereto, the wall of groove 38 and the outer edge portion of side bar 26 act respectively as a cam surface and cam follower. Restated, in the unlocked condition of a lock in accordance with the invention, rotation of core 16 relative to shell 14 will result in the side bar(s) being driven inwardly to overcome a spring bias. In prior art locks, in the absence of a properly coded key in keyway 18, this inward movement of the side bar(s) toward the plane of the keyway was prevented solely by interference between the tumblers 22 and the side bar(s). In the disclosed embodiments of the present invention, the bottom of the longitudinal groove 38 lies in a plane 42 (see, for example, FIG. 3) oriented transversely with respect to keyway plane 20 and, when a pair of side bars 26 and 28 are present, the side bars are also co-planar. Thus, in the disclosed embodiments the planes 20 and 42 intersect at the axis of rotation of core 16.

The present invention encompasses at least one additional movable member, namely a locking segment 44, received in a cut-out 46 in core 16. The cut-out 46, at a point offset from plane 42, is placed in communication with keyway 18 via a longitudinal groove 48 which, in part, defines the keyway cross-section. The cut-out 46 which receives locking segment 44 also intersects the longitudinal slot 30 in the exterior of core 16 which receives side bar 26. The locking segment 44, in the absence of a properly coded key inserted in keyway 18, prevents movement of side bar 26 in the direction of keyway 18 in the manner to be described below.

Figure 8:
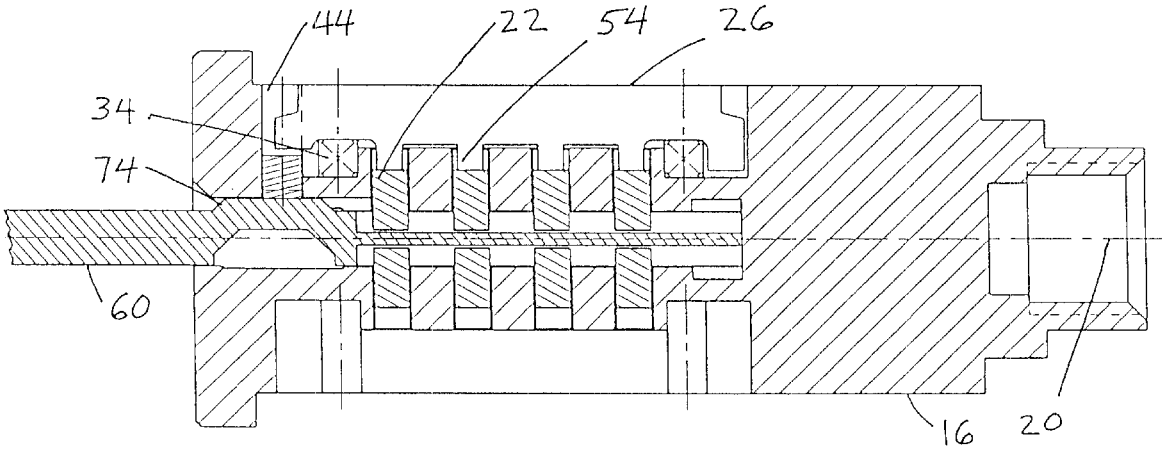
FIG. 8 is a top cross-sectional view, corresponding to FIG. 4, with elements located to the right of the center plane of the keyway omitted.
Figure 7:
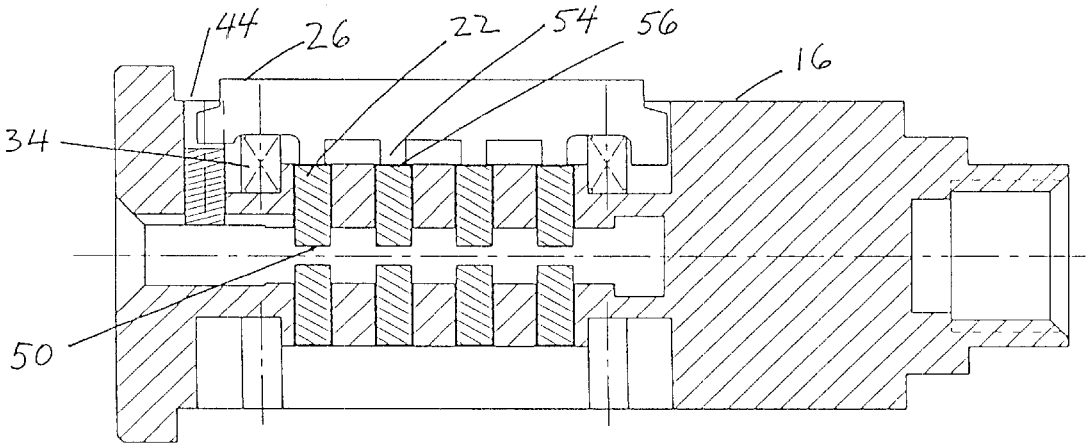
FIG. 7 is a schematic top cross-sectional view, corresponding to FIG. 3, with elements located to the right of the center plane of the keyway omitted in the interest of clarity.

To briefly further describe the pin tumblers 22, in the disclosed embodiments each tumbler is provided with an extension 50 (see, for example, FIG. 7) which projects into keyway 18. These extensions, at least on the top and bottom surfaces thereof as the lock is shown in FIG. 1, are smoothly curved. On the sides which are disposed opposite to the extensions, the tumblers 22 are provided with a pair of slots or notches 52 of different depth. These notches cooperate with fingers 54 which extend, in the direction of the keyway, from a cooperating side bar. In the locked state, as may best be seen from FIG. 7, the ends of the fingers 54 are in contact with or juxtapositioned to outwardly facing side surfaces 56 of the tumblers 22 and thus movement of the side bar(s) away from shell 14 is blocked. Reciprocation of the tumblers 22 in their respective slots 24 may place the notches 52 having the deeper depth in registration with the fingers 54 of a cooperating side bar, thus establishing a clearance which permits movement of the side bar. FIG. 8 shows side bar 26 after it has been cammed out of the cam groove 38 in the shell, motion of the side bar being permitted by movement of its fingers 54 into notches of appropriate depth in the reciprocated tumblers 22.

Figure 2:
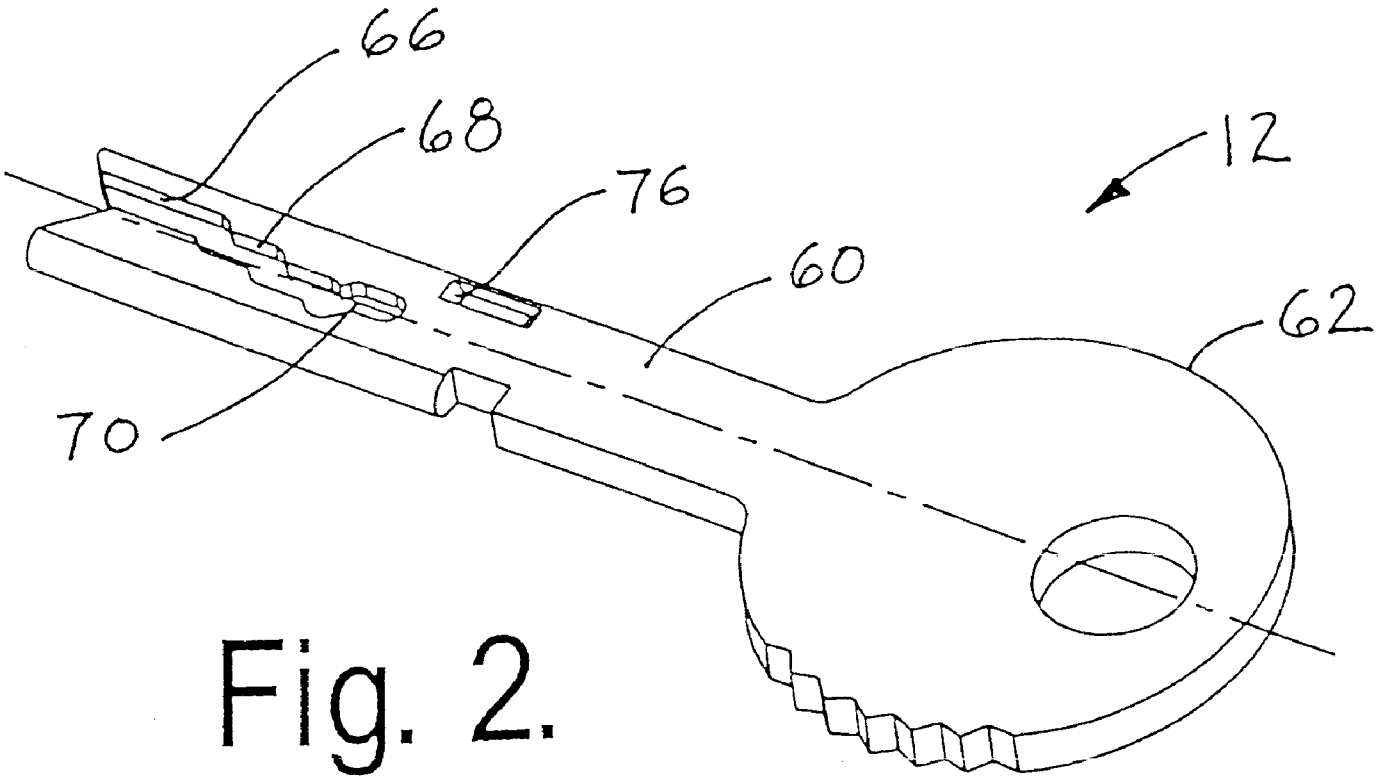
FIG. 2 is a perspective view of the key of the lock system of FIG. 1, FIG. 2 depicting the key from the opposite side when compared to FIG. 1.

The key 12 comprises a blade 60 which extends longitudinally from a bow 62 to a V-shaped tip portion. Referring simultaneously to FIGS. 1 and 2, the opposite sides of blade 60 are respectively provided with irregularly shaped, elongated code pattern grooves 64 and 66. These grooves are sized and shaped to engage the extensions 50 of the tumblers 22. Referring to FIG. 2, grooves 64 and 66 have straight code parts 68 and angled transition parts 70. The blade tip is shaped to "lead" the tumbler extensions 50 into the grooves 64 and 66. Therefore, as key blade 60 is inserted in keyway 18, the grooves 64 and 66 will engage extensions 50 on the tumblers 22 which project into keyway 18 and, during key insertion, reciprocal motion will be imparted to the tumblers as they follow the contour of the grooves. If key 12 is a "proper" key, when blade 60 is fully inserted in keyway 18, each of tumblers 22 will have been moved to a position where the deeper of the notches 52 in its outwardly facing side is in registration with, i.e., is co-planar with, a finger 54 on a cooperating side bar. Thus, a part of the combination of lock 10, which is satisfied by the vertical location of the center of the key blade side grooves 64 and 66 relative to the opposite edges of blade 60, constitutes the position of the deeper notch 52 in the outwardly facing side 56 of each of the tumblers 22.

The cut-out 46 formed in core 12 for receiving segment 44 is in the form of a circular segment having a upper and lower ends 46 A, B, flat side walls and a straight bottom wall which extends between two points of intersection with the shear line, i.e., the interface, between shell 14 and core 16. The locking segment 44 is a movable flat plate member having a shape which is similar to, but different from, the circular segment cut-out 46 in which it is received. This plate has upper and lower ends, 44 A, B and a first, straight side 44 C from which a cam follower projection 72 extends. Projection 72 is "normally", i.e., without a proper key inserted in keyway 18, disposed in the groove 48 (see FIG. 3) formed in the side of the keyway, the groove extending inwardly from the insertion end of keyway 18 and being broken through to the circular segment cut-out 46. Thus, as may be seen from FIG. 3, cam follower projection 72 may be accessed from the keyway. The groove 48 may have a length which is less than that of the keyway.

Figure 4:
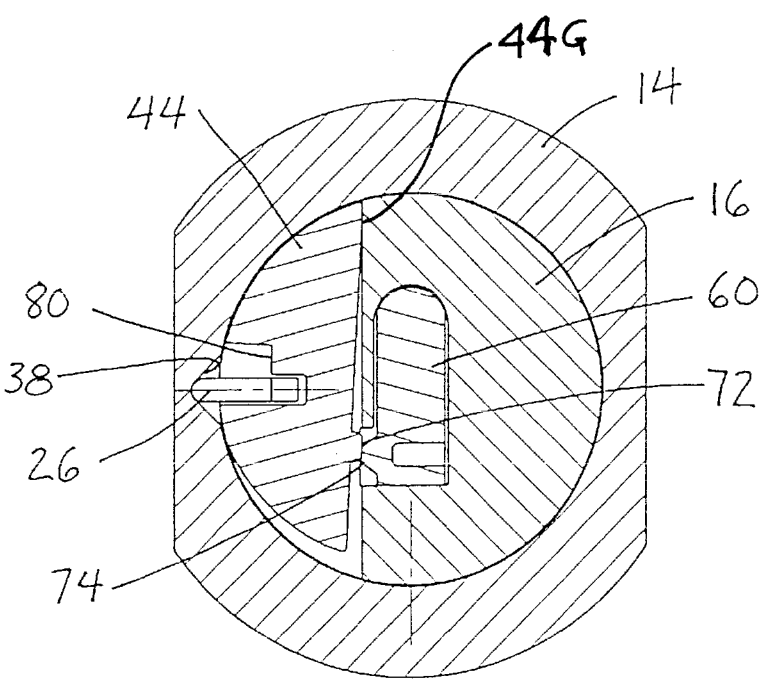
FIG. 4 is a view similar to FIG. 3 but with a proper key fully inserted in the keyway.

The plate which defines locking segment 44 also has an arcuate second side 44 D which extends between the top and bottom ends of the above-mentioned straight front. The arcuate second side is preferably, a semi-circle that confronts the inner diameter of the shell, but has a void or gap 82 therebetween near the upper end 44 A. The radius of this arcuate side is slightly less than that of the cylindrical core 16. Thus, as may be seen from FIGS. 3–6, locking segment 44 loosely fits in the circular segment cut-out 46 provided therefor in core 16 and is capable of movement relative to shell 14 in the absence of movement of core 16. As shown in FIGS. 3 and 4, movement of locking segment 44 is guided in a cam-like interaction by surface 39 on the inner diameter of shell 14.

Returning to a discussion of key 12, the side faces of blade 60, i.e., the faces in which the tumbler activation grooves 64, 66 are formed, define a pair of parallel planes. The side face of blade 60 which is juxtapositioned to the side of keyway 18 in which a groove 48 is formed includes an elongated camming projection 74. Cam 74 extends outwardly beyond the plane defined by the key blade face. During key insertion, cam 74 moves longitudinally in groove 48. The longitudinal position of cam 74 is selected such that, with key blade 60 fully inserted in keyway 18, a high or actuating portion of cam 74 will be in registration with cam follower projection 72 on locking segment 44. The portion of cam 74 which faces the tip of blade 60, i.e., the cam surface which first engages projection 72, will define a ramp whereby, as the blade 60 is inserted in the keyway 18, cam 74 will directly drivingly engage the cam follower projection 72 and thereby apply a force, directed transversely with respect to the plane 20 of keyway 18, to locking segment 44. Thus, during key blade insertion, the locking segment will rotate slightly from the position of FIG. 3 to that of FIG. 4 when a proper key is inserted in keyway 18. The height of cam 74 will be selected such that movement of segment 44 from the position of FIG. 3 to that of FIG. 4 will be achieved. Thus, the code incorporated in key 12 additionally includes the position and activation height of cam 74.

The preferred method of forming the camming projection 74 is plastically deforming the key blade 60 by, for example, stamping against a die having a cavity which is complimentary in shape to the cam. Referring to FIG. 2, the stamping process produces, in the side of blade 60 opposite to cam 74, a recess 76. Recess 76 will, at least in part, be in registration with cam projection 74.

It is to be understood that a lock in accordance with the present invention may include a plurality of locking segments. Any locking segments in addition to element 44 may be disposed on the same or opposite sides of the keyway defined plane 20. If locking segments 44 are provided on both sides of keyway 18, the cam follower projections 72 thereon will not be in alignment in a plane oriented substantially transverse to plane 20. Restated, camming projections 74 on opposite sides of key blade 60 will not be in registration but, rather, will be longitudinal and/or vertically offset from one another. In a typical reduction to practice, since force must be applied to each locking segment at a point offset from plane 42 (see FIGS. 3 and 4), the key carried camming projections and the cam followers on the locking segments will typically be coplanar, and will be longitudinally displaced along the keyway.

Referring again to FIG. 1, the arcuate side of locking segment 44 is interrupted by a stepped notch 78. Notch 78, as may clearly be seen from FIGS. 1 and 3–6, includes a first portion, defined by a shoulder 80 (see FIG. 5) and second adjoining deeper portion 80'. The stepped notch 78 is located such that, without a proper key disposed in keyway 18, a portion of the keyway facing side of side bar 26 is juxtapositioned to shoulder 80. This condition is depicted in FIG. 3 where an end portion of side bar 26 which is located closest to the keyway entrance cooperates with the locking segment 44. Referring to FIG. 6, the insertion into keyway 18 of a key which satisfies the lock combination save for the presence of a suitably sized, shaped and positioned camming projection 74, will not allow rotation of core 16 relative to shell 14 due to the establishment of contact, i.e., the interference, between side bar 26 and shoulder 80 as soon as rotation of the core is initiated.

Figure 5:
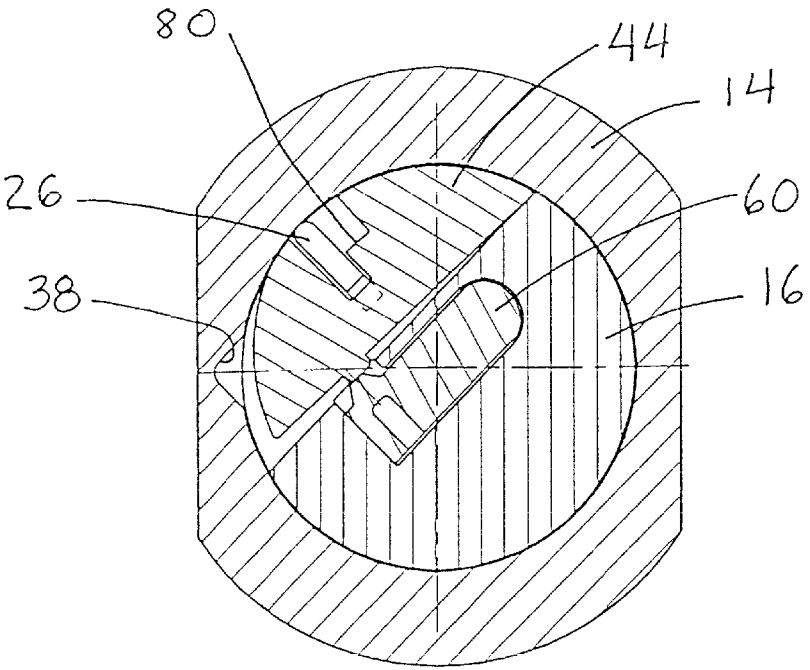
FIG. 5 is a view similar to FIG. 4 with the lock core rotated relative to the shell.

As may be seen from FIGS. 4 and 5, the insertion of a proper or authorized key in keyway 18 will result in the establishment of contact between an elongated camming projection 74 on the key blade and the cam follower projection 72 on the plate 44, i.e., the locking segment. This contact will impart slightly clockwise but predominately upward movement, relative to core 16, of the locking segment 44. This movement will be guided by the inner diameter of shell 14 at 39 and the locking segment 44 will be driven upwardly from the position of FIG. 3 to that of FIG. 4. The side bar will thus be in registration with the deeper portion 80' of notch 78 in segment 44. If, at the same time, all of the pin tumblers 22 have been reciprocated to the point where the deeper of the notches therein are in registration with the fingers 54 on a cooperating side bar the core 16 may be rotated within shell 14 as illustrated in FIG. 5.

In the preferred embodiment, the plate 44 has a first, inner side 44 C confronting the core 16, a second outer side 44 D confronting the shell 14 adjacent the groove 38, an upper end 44 A adjacent the upper end of the cut-out and a lower end 44 B adjacent the lower end of the cut-out, the plate being movable relative to the core between first and second positions along a direction generally extending between the upper and lower ends of the cut-out. The projection 72 is offset such that the projection is closer to one end 44 B of the plate than to the other end 44 A of the plate, and the notch surface 80' of the second side 44 B of the plate is closer to the one end 44 B than to the other end 44 A of the plate. A portion of the second side of the plate defines an outer cam surface located between the notch surface 80' and the one end 44 B of the plate, whereby the plate outer cam surface cooperates with the shell interior surface 39 to guide the movement of the plate relative to the core between the first and second positions. In the first position of the plate, the plate upper end 44 A and a portion 44 G of the plate second side adjacent the upper end are spaced with an intervening void 82 from the shell interior surface, and when the plate is in said second position, the lower end of the plate 44 B and a portion 44 F of the second side adjacent to the lower end of the plate are spaced from the shell interior surface, and the plate upper end 44 A and the adjacent surface 44 E are substantially in contact with the shell interior surface. In the first position, the plate is loosely disposed in the cut-out whereas when the plate is in the second position, a portion 44 G of the plate first side adjacent the plate upper end 44 A rigidly bears on the core 16, and the projection 74 on the key rigidly bears against said cam projection 72 on the plate. The plate 44 including the projection 72 remain entirely on one side of the central plane 20 in both the first and second positions.

While preferred embodiments have been illustrated and described above, various modifications may be made thereto without departing from the spirit and scope of the invention. Accordingly, it is to be understood that the present invention has been described by way of illustration and not limitation.

What is claimed is:

1. A cylinder lock comprising:

a shell, said shell having an interior surface which defines a core receiving chamber having an axis, said shell having at least a first longitudinal cam groove extending along said interior surface, said shell being mounted with a fixed orientation in the use environment of said lock;

a rotatable core cooperating with said shell to form the relatively movable component of said lock, said core having an exterior surface and being disposed within said core receiving chamber of said shell for rotation about said chamber axis, said core defining a longitudinally extending keyway having oppositely disposed sides which define a central plane, said core having at least a first array of tumbler receiving chambers, said tumbler receiving chambers extending between said keyway and said exterior surface of said core, said core further having a longitudinal slot in said exterior surface, said longitudinal slot being alignable with said shell longitudinal cam groove, said core longitudinal slot intersecting said chambers of said array, said core additionally having a cut-out which has upper and lower ends and extends from said exterior surface in the direction of said keyway, said cut-out intersecting said longitudinal slot and being in communication with said keyway via an opening in the first side of said keyway, an arcuate shear line for said lock being defined by the interface between said interior surface of said shell and said exterior surface of said core, said shear line having a radius of curvature;

tumblers reciprocally disposed in respective of said core tumbler receiving chambers, said tumblers each having at least a first notch in a side thereof which faces generally in the direction of said shell interior surface, said tumblers each further having an activation surface which is disposed in said keyway;

an elongated side bar located in said longitudinal slot in said core exterior surface, said side bar having outwardly projecting fingers which extend into said tumbler receiving chambers, said fingers being sized and shaped to cooperate with said tumbler notches;

means resiliently biasing said side bar in the direction of said shell whereby said side bar engages said shell cam groove and bridges said shear line when said lock is in the locked condition; and a plate loosely disposed in said cut-out in said core, said plate having a first, inner side confronting said core, a second outer side confronting the shell adjacent said groove, an upper end adjacent the upper end of the cutout and a lower end adjacent the lower end of the cut-out, said plate being movable relative to said core between first and second positions along a direction generally extending between the upper and lower ends of the cutout, said plate having a cam follower projection on the first side thereof, said plate projection being located to extend into said keyway via said opening whereby force to impart movement to said plate between said first and second positions may be delivered to said projection by direct, rigid contact with a key inserted in said keyway, said plate having at least a pair of adjacent surfaces on the second side thereof, said adjacent surfaces respectively being displaced first and second distances from said first side of said keyway, said first of said adjacent surfaces being juxtapositioned to said sidebar in said first position of said plate whereby said plate will prevent movement of said sidebar in a direction of said keyway and out of engagement with said shell cam groove, said second of said adjacent surfaces being in registration with said sidebar when said plate is in said second position whereby said plate does not impede movement of said sidebar out of said shell cam groove and in the direction of said keyway.

2. A lock as recited in claim 1 wherein said cut-out in said core has generally the shape of a circular segment, and said plate has the general shape of a semi-circle having a radius of curvature smaller than the shear line radius of curvature.

3. A lock as recited in claim 1, wherein said sidebar movement is along a plane that intersects said chamber axis, and the projection of said plate is offset from said plane of sidebar movement.

4. A lock as recited in claim 3, wherein said projection is offset such that said projection is closer to one end of the plate than to the other end of the plate, and said second adjacent surface of the second side of the plate is closer to said one end than to said other end of the plate.

5. A lock as recited in claim 4 wherein a portion of said second side of the plate defines an outer cam surface located between said second adjacent surface and said one end of the plate, whereby said plate outer cam surface cooperates with said shell interior surface to guide the movement of said plate relative to said core between said first and second positions.

6. A lock as recited in claim 5, wherein in said first position of the plate, said plate upper end and portion a of said plate second side adjacent said upper end are spaced with an intervening void from the shell interior surface, and when the plate is in said second position, the lower end of the plate and a portion of the second side adjacent to the lower end of the plate are spaced from the shell interior surface, and the plate upper end and said adjacent surface are substantially in contact with the shell interior surface.

7. A lock as recited in claim 1, wherein when the plate is in said first position, the plate upper end and the plate lower end are substantially in contact with said core, whereas when the plate is in said second position, the upper end of the plate is in contact with said core, and said lower end of the plate is spaced from said core.

8. A lock as recited in claim 7, wherein when the plate is in said first position, the second side adjacent to said upper end is spaced from said shell interior surface whereas when the plate is in said second position, the second side adjacent said lower end is spaced from the shell interior surface.

9. A lock as recited in claim 1, wherein in said first position, said plate is loosely disposed in said cut-out whereas when the plate is in said second position, a portion of the plate first side adjacent the plate upper end rigidly bears on the core, and said projection on the key rigidly bears against said cam projection on the plate, said plate including said projection remaining entirely on one side of said central plane in said first and second positions.

10. A lock as recited in claim 1, wherein a portion of said second side of the plate defines an outer cam surface located between said second adjacent surface and said one end of the plate, whereby said plate outer cam surface cooperates with said shell interior surface to guide the movement of said plate relative to said core between said first and second positions.

11. A lock as recited in claim 10, wherein in said first position, said plate is loosely disposed in said cut-out whereas when the plate is in said second position, a portion of the plate first side adjacent the plate upper end rigidly bears on the core, and said projection on the key rigidly bears against said cam projection on the plate, said plate including said projection remaining entirely on one side of said central plane in said first and second positions.

12. A lock as recited in claim 1, wherein in said first position of the plate, said plate upper end and portion a of said plate second side adjacent said upper end are spaced with an intervening void from the shell interior surface, and when the plate is in said second position, the lower end of the plate and a portion of the second side adjacent to the lower end of the plate are spaced from the shell interior surface, and the plate upper end and said adjacent surface are substantially in contact with the shell interior surface.

13. A lock as recited in claim 12, wherein in said first position, said plate is loosely disposed in said cut-out whereas when the plate is in said second position, a portion of the plate first side adjacent the plate upper end rigidly bears on the core, and said projection on the key rigidly bears against said cam projection on the plate, said plate including said projection remaining entirely on one side of said central plane in said first and second positions.

14. A lock as recited in claim 1 wherein said tumbler activation surfaces comprise extensions which project into said keyway.

15. A lock as recited in claim 14 wherein said tumbler extensions and said tumbler first notches are located on oppositely disposed surfaces of said tumblers.

16. A lock as recited in claim 1 wherein said first and second adjacent surfaces on said plate are defined by a stepped notch in said plate.

17. A lock as recited in claim 16 wherein said cut-out in said core has generally the shape of a circular segment.

18. A cylinder lock system comprising:

a key, said key having a bow portion and a blade which longitudinally extends from said bow portion, said blade having a pair of spaced side surfaces which are at least in part substantially parallel and interconnected by a pair of edges extending therebetween, said key blade further having a camming projection extending laterally from one of said side surfaces, said key blade additionally having surface irregularities which define the key bitting;

a shell, said shell having an interior surface which defines a core receiving chamber having an axis, said shell having at least a first longitudinal cam groove extending along said interior surface, said shell being mounted with a fixed orientation in the use environment of said lock;

a rotatable core cooperating with said shell to form the relatively movable component of said lock, said core having an exterior surface and being disposed within said core receiving chamber of said shell for rotation about said chamber axis, said core defining a longitudinally extending keyway having oppositely disposed sides, said core having at least a first array of tumbler receiving chambers, said tumbler receiving chambers extending between said keyway and said exterior surface of said core, said core further having a longitudinal slot in said exterior surface, said longitudinal slot being alignable with said shell longitudinal cam groove, said core longitudinal slot intersecting said chambers of said array, said core additionally having a cut-out which extends from said exterior surface in the direction of said keyway, said cut-out intersecting said longitudinal slot and being in communication with said keyway via an opening in a first side of said keyway, a shear line for said lock being defined by the interface between said interior surface of said shell and said exterior surface of said core;

tumblers reciprocally disposed in respective of said core tumbler receiving chambers, said tumblers each having at least a first notch in a side thereof which faces generally in the direction of said shell interior surface, said tumblers each further having an activation surface which is disposed in said keyway for cooperation with said key blade surface irregularities;

an elongated side bar located in said longitudinal slot in said core exterior surface, said side bar having outwardly projecting fingers which extend into said tumbler receiving chambers, said fingers being sized and shaped to cooperate with said tumbler notches;

means resiliently biasing said side bar in the direction of said shell whereby said side bar engages said shell cam groove and bridges said shear line when said lock is in the locked condition; and a plate disposed in said cut-out in said core, said plate having upper and lower ends and a first side confronting said core, said plate being movable relative to said core between first and second positions, said plate having a cam follower projection on said first side thereof, said plate projection being located to extend into said keyway via said opening whereby force to impart movement to said plate may be delivered to said projection from a key inserted in said keyway, said plate having at least a pair of adjacent side bar movement control surfaces on a second side thereof which is disposed opposite to said plate first side, said control surfaces respectively being displaced first and second distances from said first side of said keyway, said first control surface being juxtapositioned to said side bar in said first position of said plate whereby said plate will prevent movement of said side bar in the direction of said keyway and out of engagement with said shell cam groove, said second control surface being in registration with said side bar when said plate is in said second position whereby said plate does not impede movement of said side bar out of said shell cam groove and in the direction of said keyway.

19. The cylinder lock system of claim 18 wherein said tumbler activation surfaces comprise tumbler extensions which project into said keyway at said first side thereof and wherein said key bitting defining blade surface irregularities are located on said one of said blade side surfaces.

20. The cylinder lock system of claim 19 wherein said key bitting defining surface irregularities comprise portions of a longitudinal slot in said key blade one side, said slot extending from said blade tip in the direction of said bow and including code parts separated by transition parts, said key blade slot engaging said tumbler extensions during insertion of said blade into said keyway.

21. A lock system as recited in claim 18, wherein in said first position of the plate, said plate upper end and portion of said plate second side adjacent said upper end are spaced with an intervening void from the shell interior surface, and when the plate is in said second position, the lower end of the plate and a portion of the second side adjacent to the lower end of the plate are spaced from the shell interior surface, and the plate upper end and said adjacent surface are substantially in contact with the shell interior surface.

22. A lock system as recited in claim 18, wherein, said sidebar movement is along a plane that intersects said chamber axis, and the projection of said plate is offset from said plane of sidebar movement;

said projection is offset such that said projection is closer to one end of the plate than to the other end of the plate, and said second central surface of the second side of the plate is closer to said one end than to said other end of the plate;

a portion of said second side of the plate defines an outer cam surface located between said second adjacent surface and said one end of the plate, whereby said plate outer cam surface cooperates with said shell interior surface to guide the movement of said plate relative to said core between said first and second positions;

in said first position, said plate is loosely disposed in said cutout whereas when the plate is in said second position, a portion of the plate first side adjacent the plate upper end rigidly bears on the core, and said projection on the key rigidly bears against said cam projection on the plate; and said plate including said projection remain entirely on one side of said central plane in said first and second positions.

* * * * *